US007226628B2

(12) United States Patent
Cai

(10) Patent No.: US 7,226,628 B2
(45) Date of Patent: Jun. 5, 2007

(54) COMBINED COFFEE PACKAGE AND DISPENSER

(76) Inventor: Edward Z. Cai, 4767 NW. Jeanice Pl., Corvallis, OR (US) 97330

( * ) Notice: Subject to any disclaimer, the term of this patent is extended or adjusted under 35 U.S.C. 154(b) by 739 days.

(21) Appl. No.: 10/356,935

(22) Filed: Jan. 31, 2003

(65) Prior Publication Data

US 2004/0149135 A1 Aug. 5, 2004

(51) Int. Cl.
*B65B 29/02* (2006.01)

(52) U.S. Cl. ..... 426/77; 426/108; 426/115; 426/118; 426/119; 426/122; 426/123

(58) Field of Classification Search ..... 426/77, 426/79, 108, 112, 115, 118, 119, 122, 123; 206/0.5

See application file for complete search history.

(56) References Cited

U.S. PATENT DOCUMENTS 1,413,064 A * 4/1922 Salfisberg ..... 206/538
1,746,899 A * 2/1930 Witt ..... 426/81
2,004,486 A * 6/1935 Cooper ..... 426/77
2,042,039 A * 5/1936 Cooper ..... 426/77
2,069,334 A * 2/1937 Salfisberg ..... 206/466
2,149,713 A * 3/1939 Webber ..... 426/83
3,054,679 A * 9/1962 Bradford ..... 426/123
3,390,766 A * 7/1968 Stockdale ..... 206/427
3,414,414 A * 12/1968 Christine et al. ..... 426/122
3,526,317 A * 9/1970 Vanders ..... 206/217
3,835,224 A * 9/1974 Peters ..... 426/130
3,865,953 A * 2/1975 Peters ..... 426/124
3,983,999 A * 10/1976 Morton ..... 229/120.011
4,000,846 A 1/1977 Gilbert
4,022,373 A 5/1977 Kohnlein et al.
4,138,014 A * 2/1979 Bouman ..... 206/542
4,169,540 A 10/1979 Larsson et al.
4,413,464 A 11/1983 Larsson et al.
4,449,243 A 5/1984 Platel
4,871,555 A * 10/1989 Schwartz et al. ..... 426/82
4,966,780 A 10/1990 Hargraves et al.
5,125,542 A 6/1992 Blanc
5,236,749 A * 8/1993 Ewing ..... 428/35.2
5,322,701 A * 6/1994 Cullen et al. ..... 426/124
5,352,466 A 10/1994 Delonis
5,445,291 A 8/1995 Daniel
5,529,179 A * 6/1996 Hanson ..... 206/219
5,664,670 A * 9/1997 Cozzie ..... 206/216
5,692,837 A 12/1997 Beer (Continued)

*Primary Examiner*—Drew Becker

(57) ABSTRACT

A thin sheet of sealed coffee grounds comprises a plurality of filter packs, a rigid substrate sheet, a flexible barrier sheet sealed to the substrate sheet via a plurality of ring-shaped seals to form a plurality of chambers to contain the plurality of filter packs, a plurality of cut lines outside the plurality of seals for isolating the chambers from one another, and a plurality of grippable tabs for dispensing the filter packs from the thin sheet. The grippable tabs are adapted to allow a user to dispense a filter pack at a time from the thin sheet by simply pulling a grippable tab to open a chamber and release the filter pack therein. The substrate sheet has a smooth top surface in one aspect of the invention and a plurality of cylindrical cavities sealed by the flexible barrier sheet via the ring-shaped seals in another aspect of the invention. In a further aspect of the invention the plurality of filter packs in the thin sheet is replaced by a plurality of portions of loose coffee grounds.

33 Claims, 4 Drawing Sheets

U.S. PATENT DOCUMENTS 5,860,562 A 1/1999 Fedak
5,885,633 A * 3/1999 Lehrer ..... 426/77
5,931,117 A 8/1999 Lantz et al.
6,254,908 B1 7/2001 Winters
6,485,766 B2 * 11/2002 Herod ..... 426/78
6,851,550 B2 * 2/2005 Bishop et al. ..... 206/0.5
7,051,762 B2 * 5/2006 Haamer ..... 137/855

* cited by examiner

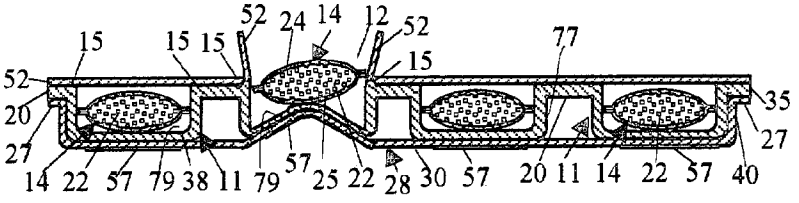
Fig. 8b
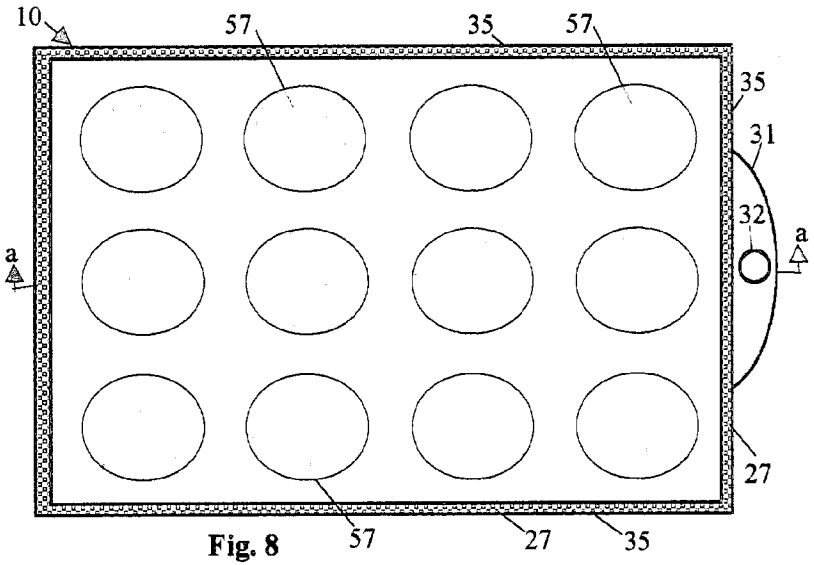
Fig. 8
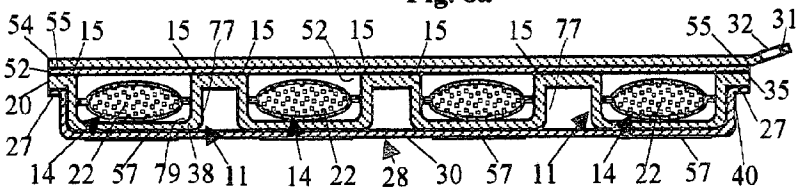
Fig. 8a
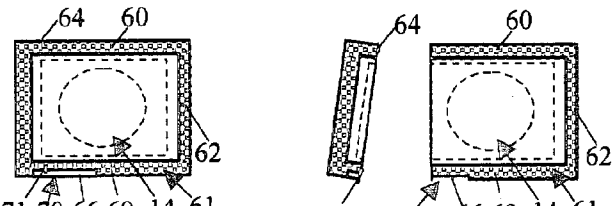
Fig. 7c
Fig. 7b
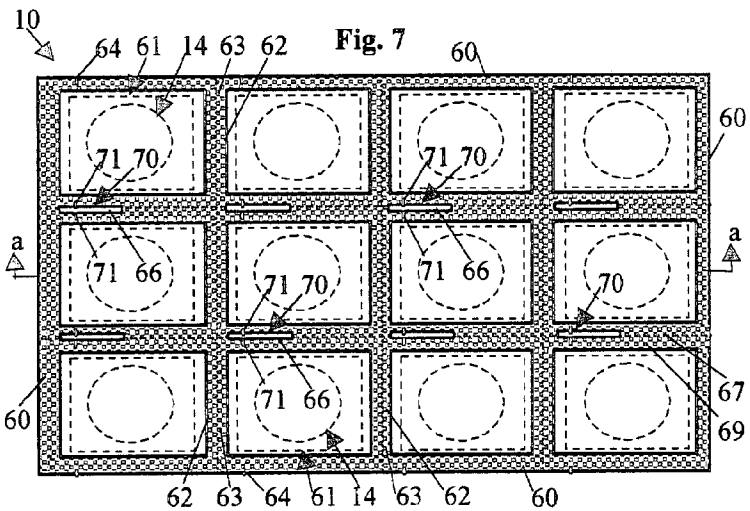
Fig. 7
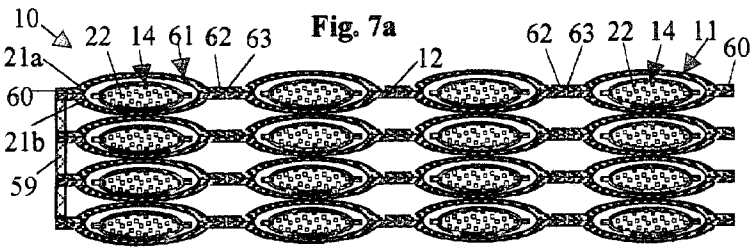
Fig. 7a

COMBINED COFFEE PACKAGE AND DISPENSER

FIELD OF THE INVENTION

The present invention relates to a package for beverage materials such as coffee grounds, tea, latte and mocha mixes, and particularly to a package for better preserving the aroma and flavor of the beverage materials as well as for easier dispensing of the beverage materials.

BACKGROUND OF THE INVENTION

To prevent loss of aroma or flavor, coffee grounds and tea have been packaged under vacuum or inert gas in gas-impermeable containers such as cans and bags. A first problem with such package is that the user has to measure and handle the messy loose grounds. A second problem is that once the sealed container is opened, the aroma quickly escapes and the moisture and oxygen in atmosphere quickly enter the container, causing quick flavor deterioration of the remaining coffee grounds in the container.

Recently, coffee grounds has been pre-measured and then sandwiched between paper filters to form a filter pack or cartridge. About a dozen such filter packs are then packaged in one gas-impermeable can or bag to preserve the aroma and flavor of the coffee grounds in the filter packs. This improved packaging solved the above first problem, but still has the second problem. To address both the problems, coffee grounds has been first pre-measured and packaged as filter packs. Each filter pack is then immediately packaged or sealed in a gas-impermeable film pouch. About a dozen such film pouches are then packaged in a box for storage. Although such a package resolved the both the above problems, it significantly increases the cost for a cup of coffee due to its high packaging cost, and is thus not affordable by some consumers. In addition, such a package is inconvenient to use since it requires numerous steps, although each step is simple, to obtain a filter pack. Such steps includes opening the box, removing a film pouch from box, tearing the pouch to open it, pulling the filter pack out of the pouch, and closing the box. Furthermore, such a package may cause deformation to the shape of the filter packs and changes in packing density of the coffee grounds in a filter pack during transportation and handling, thus making the strength of brewed coffee inconsistent. The present invention intends to provide a new packaging method for beverage materials to resolve all above problems.

SUMMARY OF THE INVENTION

In accordance with the present invention, there is provided a combined package and dispenser for coffee grounds and the like. The combined package and dispenser comprises a thin, sufficiently flat sheet of sealed coffee grounds. The sheet of sealed coffee grounds comprises a plurality of coffee cartridges or filter packs, a rigid substrate sheet having a rectangle side wall, a flexible barrier sheet sealed to the substrate sheet via a plurality of ring-shaped hermetic seals to form a plurality of cartridge chambers for containing the plurality of cartridges, a plurality of cut lines outside and around the plurality of hermetic seals for isolating one cartridge chamber from its adjacent ones, and a plurality of grippable tabs for dispensing the coffee cartridges. The plurality of grippable tabs comprise tab bases connected to the hermetic seals and are adapted to enable a user to dispense a beverage cartridge at a time from the sheet of sealed coffee grounds by simply pulling a grippable tab to open a cartridge chamber and release the beverage cartridge therein. The substrate sheet comprises a substantially flat top surface according to one aspect of the invention and comprises a plurality of cylindrical cavities sealed by the flexible barrier sheet via the ring-shaped hermetic seals to form the cartridge chambers according to another aspect of the invention. The sheet of sealed coffee grounds may further comprise a cover having a substantially flat top wall for facilitating the stacking of the sheets of sealed coffee grounds over each other, a side wall and a peripheral fringe 27 sealed to the peripheral edge of the substrate sheet, an anti-bulging device to prevent the cover from bulging out by the out-gas from fresh coffee grounds, and a mechanism for conducting the out-gas from each sealed cartridge chamber to the anti-bulging device.

The thin sheet of sealed coffee grounds offers several unique advantages over known packaging methods for coffee grounds. First of all, it has greatly simplified the dispensing of a coffee cartridge from a package. To dispense a coffee cartridge, one simply picks up a thin sheet from a countertop or shelf and pulls a grippable tab to release a cartridge from the thin sheet. In comparison, to dispense a cartridge from a box of coffee cartridges, the user needs to move out the box, to open the lid of the box, to remove a film pouch from the box, to tear the pouch to open it, to pull the cartridge out of the pouch, and to close the lid for the box. Secondly, the thin sheet of sealed coffee grounds has enabled significant savings in package cost and materials since it eliminate the need for no boxes or cans. Third, the thin sheet takes less and less space as the coffee cartridges in it are dispensed. Forth, the individual cartridge chambers in the thin sheet prevent the cartridges from being deformed and the coffee grounds in cartridges from regrouping during transportation and handling. Finally, the thin sheet enables a consumer to tell instantly how many cartridges are left on it, thus reducing the chance of being caught out of cartridges right before brewing coffee.

According to another preferred embodiment of the invention, the thin sheet comprises a plurality of portions of loose coffee grounds in the cartridge chambers rather than a plurality of coffee cartridges. The cut lines are through both the flexible barrier sheet and substrate sheet to allow each cartridge chamber to be removed along the cut line from the thin sheet as a sealed scoop with a handle. When making coffee, one pulls the grippable tab on the scoop to open the cartridge chamber and then holds the handle to pour the portion of coffee grounds into a basket filter or disposable paper filter for a coffee machine.

According to a further preferred embodiment of the invention, the thin sheet comprises a plurality of coffee cartridges, an top flexible barrier sheet, a lower flexible barrier sheet sealed to the top flexible barrier sheet to form a plurality of horizontal and vertical seal strips to define a plurality of cartridge chambers for containing the cartridges. A plurality of perforated lines are formed on the plurality of horizontal and vertical seal strips to allow the removal of one or more cartridge chambers from the thin sheet along the perforated line(s). A plurality of nips are formed on the horizontal seal strips to allow a user to open a cartridge chamber and remove the cartridge therein. The thin sheet further comprises a plurality of seal protectors on the horizontal seal strips to prevent undesired opening of cartridge chambers during the removal of cartridge chambers from the thin sheet along the perforated line(s).

According to a last preferred embodiment, the thin sheet comprises a plurality of coffee cartridges, a substrate sheet having a plurality of cylindrical cavities for receiving the plurality of coffee cartridges, and an easy-to-break barrier film sealed to the substrate sheet to close the plurality of cavities to form a plurality of closed chambers. The cylindrical cavity has a sufficiently flat bottom wall and rigid side to prevent the breakage of the easy-to-break barrier film cavity during transportation and storage. A punch protector may be removably attached to the top surface of the substrate sheet to protect the easy-to-break barrier film. Prior to use, the punch protector must be removed from the thin sheet. To dispense a coffee cartridge, one simply pushes a bottom wall of a cavity to push the coffee cartridge therein outwards to the easy-to-break barrier film, therefore releasing the cartridge from the thin sheet. The thin sheet may further comprise a gas-impervious cover having a flat bottom wall and a peripheral fringe sealed to the substrate sheet and a plurality of visual indicators on the flat bottom wall of the cover to indicate the positions of the bottom walls of cavities, thus guiding a user about where to push to dispense a coffee cartridge in the sheet.

It is an object of the present invention to provide a coffee package that ensures the freshness for the last filter pack or the last portion of coffee grounds dispensed from the coffee package.

It is a further object of the present invention to provide a combined beverage package and dispenser that significantly simplifies and speeds up the dispensing of a beverage filter pack or a portion of beverage materials from the beverage package.

It is object of the present invention to provide a coffee package that eliminates the use of boxes or cans, therefore offering significant savings in package materials and cost.

It is object of the present invention to provide a coffee package that protects the filter packs against deformation in shape and change in degree of packing of the coffee grounds.

It is object of the present invention to provide a coffee package that saves space.

It is object of the present invention to provide a coffee package that allows consumers to tell instantly how many coffee filter packs or how many portions of coffee grounds left in the coffee package.

These and other objectives and advantages of the present invention will become apparent from the following description of the preferred embodiments, taken together with the accompanying drawings.

DESCRIPTION OF THE DRAWING

The accompanying drawing illustrates diagramatically non-limitative embodiment of the invention, as follows:

FIG. 7 is a top view of a sheet of sealed coffee grounds according to a seventh preferred embodiment of the invention;

FIG. 7*a* is a sectional view along line a—a of FIG. 7;

FIG. 7*b* is a top view of a sealed pouch removed from the sheet of sealed coffee grounds of FIG. 7;

FIG. 7*c* shows the breaking of the sealed pouch of FIG. 7*b* to allow the removal of the coffee pack or pod therein;

FIG. 8 is a top view of a sheet of sealed coffee grounds according to an eighth preferred embodiment of the invention;

FIG. 8*a* is a sectional view along line a—a of FIG. 8;

FIG. 8*b* shows removal of a coffee filter pack from the sheet of sealed coffee grounds of FIG. 8.

DETAILED DESCRIPTION OF THE PREFERRED EMBODIMENTS

Figure 1C:
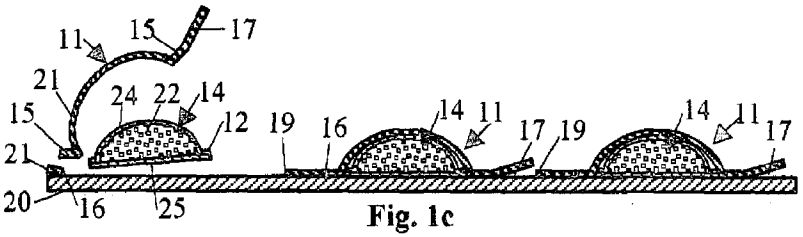
FIG. 1*c* is a sectional view of FIG. 1*b* showing the dispensing of a coffee pack or pod from the sheet of sealed coffee grounds.
Figure 1B:
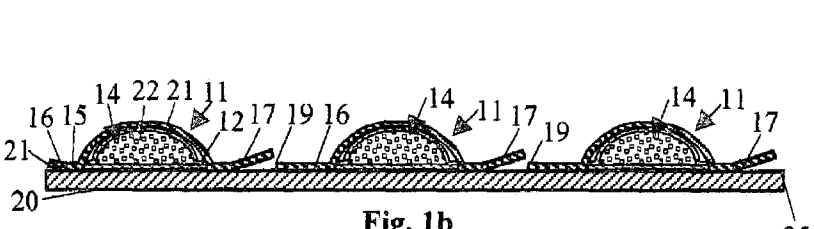
FIG. 1*b* is a sectional view along line b—b of FIG. 1.

FIGS. 1, 1*a*, 1*b* and 1*c* show a thin and sufficiently flat sheet of sealed coffee grounds 10 according to a first preferred embodiment of the invention. The sheet 10 comprises a plurality of coffee cartridges 14, a rigid substrate sheet 20 having rectangle side wall 35, a flexible barrier sheet 21 sealed to the top surface of the substrate sheet via a plurality of ring-shaped hermetic seals 15 to form a plurality of cartridge chambers 11 for containing the plurality of beverage cartridges, a plurality of cut lines 18 around the plurality of hermetic seals 15, and a plurality of grippable tabs 19 for dispensing the plurality of coffee cartridges 14 on the sheet 10. Each of the plurality of grippable tabs is connected at its base to the outside edge of a hermetic seal 15 to enable a user to dispense a beverage cartridge at a time from the sheet 10 by simply pulling a grippable tab 19 to open a cartridge chamber 11 and release the beverage cartridge 14 therein. Each cut line 18 comprises a clean-cut, i.e. completely or thoroughly cut, section 17 for forming a grappable tab 19 for the cartridge chamber and a perforated section 16 for sufficiently isolating a cartridge chamber from its adjacent cartridge chambers so that the opening of one cartridge chamber will not break the hermetic seals 15 for the adjacent cartridge chambers. Each coffee cartridge 14 comprises a predetermined amount of coffee grounds 22 enclosed in a filtration chamber formed by sealing a top paper filter 24 to a bottom filter 25 around their peripheral edges 12 (FIG. 1*c*).

The grippable tabs 19 are formed approximately 15 to 75 degrees, preferably about 45 degrees, relative to a center lines connecting the center points of the hermetic seals in a row or column of cartridge chambers on the sheet 10. Such an arrangement is found to not only enable a longer grippable tab for better gripping but also increase the number of coffee cartridges that can be sealed on the sheet 10. To facilitate the gripping by a user, the plurality of grappable tabs 19 are raised from the substrate sheet 20 (FIGS. 1*a–c*) during the manufacturing of the sheet 10 by vacuum sucking the tab 19 during or after making the clean-cuts 17. To prevent breakage during pulling a grippable tab to open a cartridge chamber, the perforated section 16 in a cut line 18 is located outside the hermetic seal 15 for the cartridge chamber. To reduce the force needed to open a cartridge chamber 11, each grippable tab is connected to the flexible barrier sheet at a position sufficiently close to the hermetic seal 15 for the cartridge chamber 11, preferably to the outside of the hermetic seal 15.

The substrate sheet 20 has sufficient rigidity to prevent or reduce its deformation during pulling the grippable tabs to open the cartridge chambers 11, thereby facilitating the dispensing or removal of the cartridges 14 from the sheet 10. The substrate sheet 20 and flexible barrier sheet 21 have sufficient gas barrier to the aroma in the coffee grounds and oxygen and moisture in air to prevent the deterioration of the coffee grounds. To reduce the mass and thus the cost of the substrate sheet, the substrate sheet 20 may comprise a sufficiently rigid sheet of porous materials such as paperboard, paper, plastic foam or wood to achieve the rigidity and a metal foil or polymeric barrier film laminated to the porous sheet to achieve the gas barrier. The substrate sheet can also comprise a plastic sheet of plastics such as polyester and polypropylene with sufficient thickness to achieve the rigidity and a thin metal barrier layer vacuum-deposited on the plastic sheet or polymeric barrier layer attached to the plastic sheet for the gas barrier. The substrate sheet can also be a low-cost metal such as aluminum sheet of 0.05 to 0.5 mm thick to achieve both the rigidity and gas barrier needed. The substrate sheet can also be a sufficiently thick plastic sheet such as a polyester sheet of about 0.1 to 0.5 mm thick to achieve both the rigidity and gas barrier needed. A fringe may be formed around the edge 35 of the substrate sheet to enhance the rigidity of the sheet 10. It is however appreciated that a non-rigid sheet or film can be used, although not preferred, as the substrate sheet according to the invention. The flexible barrier sheet 21 can be a laminated or co-extruded gas-impervious film and should have sufficient strength to prevent breakage of the grippable tabs 17 when the user pulls a tab to dispense a coffee cartridge from the sheet 10. For example, flexible barrier sheet 21 can be a laminated film having an aluminum foil for providing the barrier and a polyester layer for providing the strength. A heat-activable adhesion layer such as a polyethylene, polyacrylic and poly(ethyl vinyl acetate) layer may be formed on one or both of the substrate sheet 20 and flexible barrier sheet 21 to allow the formation of the hermetic seals 15 between the substrate sheet and flexible barrier sheet.

As a result of the thinness and sufficient flatness of the sheet 10, a plurality of such sheets 10 can be stacked over each other (FIG. 1*a*) on kitchen shelves, drawers or even countertops. Due to the inherent organization offered by the sheet 10, no boxes or cans are required for containing the coffee cartridges, which not only enables significant savings in package cost and materials but also makes the dispensing of the cartridge significantly easier. To obtain a coffee cartridge from sheet 10, a user simply picks up a sheet 10 from countertop and pulls a grippable tab 19 to dispense a cartridge from the sheet. In comparison, to obtain a cartridge from a can or box of coffee cartridges individually sealed in film pouches, the user needs to move out the can or box, to open the lid of the can or box, to remove a film pouch from the can or box, to tear the pouch to open it, to pull the cartridge out of the pouch, and to close the lid for the can or box. Another advantage for the sheet 10 is that it always displays to the user how many cartridges is left on the sheet without having to open a can or box, therefore reducing the chance of being out of coffee cartridges for making coffee. An additional advantage is that unlike the can or box which occupies no less storage space even after it becomes empty, the sheet 10 takes less and less space as the coffee cartridges are being dispensed or removed from it.

Figure 2A:
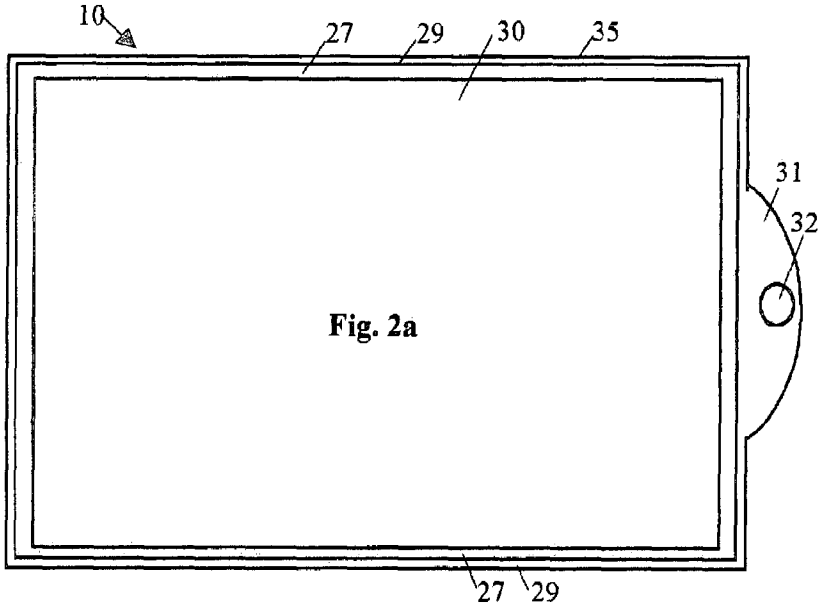
FIG. 2*a* is a top view of the sheet of sealed coffee grounds of FIG. 2.
Figure 1:
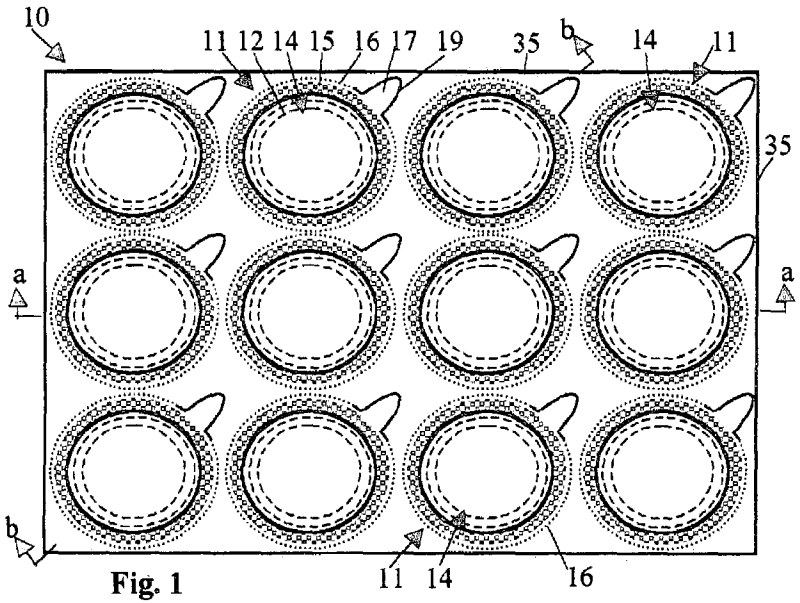
FIG. 1 is a top view of a sheet of sealed coffee grounds according to a preferred embodiment of the invention.
Figure 2:
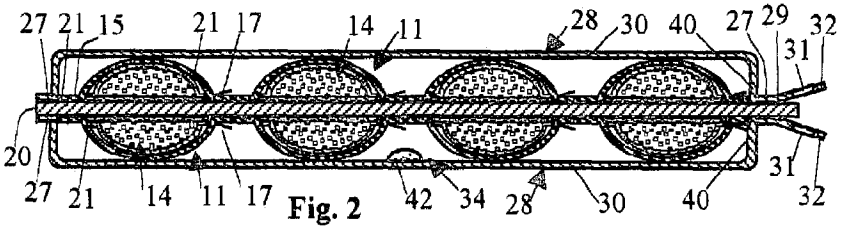
FIG. 2 is a sectional view of a sheet of sealed coffee grounds according to a second preferred embodiment of the invention.
Figure 1A:
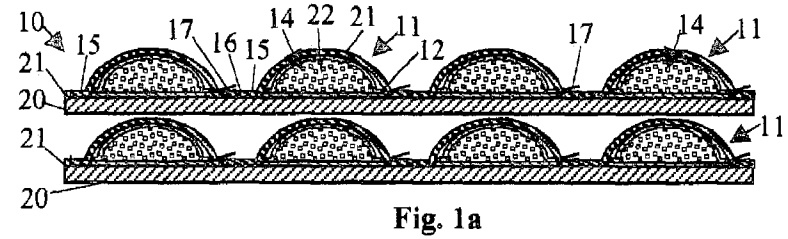
FIG. 1*a* is a sectional view along line a—a of FIG. 1.

FIGS. 2 and 2*a* show a modified version of the sheet 10 of FIGS. 1, and 1*a–c* according to another embodiment of the invention. In this modified version, the sheet 10 further comprises a cover 28 for covering and protecting the plurality of cartridge chambers 11. The cover 28 has a substantially flat top wall 30 located parallel to the substrate sheet 20 for facilitating the stacking of a plurality of sheets 10 over each other, a side wall 40 and a peripheral fringe 27 sealed to the peripheral edge of the substrate sheet, and a handle 32 for allowing the user to remove the cover 28 from the sheet 10 prior to dispensing the coffee cartridges 14. An opening 31 is formed on the handle 32 for facilitating the removal of the cover 28 or for allowing one to hang the sheet 10 on a hanger. To fully exploit the capacity of substrate sheet 20, a second plurality of coffee cartridges 14 is assembled onto the lower surface of the substrate sheet 20 by a second flexible barrier sheet 21 sealed via a second plurality of ring-shaped hermetic seals 15 to the substrate sheet. A second plurality of grippable tabs 19 and cut lines 16 are formed on the second flexible barrier sheet 21 and a second cover 28 are sealed to lower surface of the substrate sheet.

For coffee cartridges 14 that contains coffee grounds from coffee beans roasted within a day or several hours, an anti-bulging device 34 is required to prevent the cover from bulging out by coffee out-gassing. The anti-bulging device is placed on the second cover 28 and comprises a supply of absorber materials 42 for carbon dioxide out-gassed from the freshly roasted coffee grounds. A gas passageway (not shown) is formed on the substrate sheet 20 to conduct the carbon dioxide out-gassed by the coffee cartridges on the upper surface of the substrate sheet to the device 34. To prevent the cartridge chambers 11 from being over-pressurized or damaged by the out-gassed carbon dioxide, the flexible barrier sheet 21 can be made perm-selective to carbon dioxide, i.e. can be made to allow carbon dioxide to permeate through at sufficiently higher rate than oxygen and aroma. Since coffee grounds from freshly roasted beans can out-gas up to 3 ml carbon dioxide per gram of grounds within the first two days of roasting, a coffee cartridge containing seven grams of grounds for one cup of coffee would out-gas up to 21 ml of gas, which requires the flexible barrier sheet 21 to have very high permeability to carbon dioxide. An example of a flexible barrier sheet with such high permeability to carbon dioxide is a co-extruded film having a structure of 0.3 mil poly(ethyl vinyl acetate)/0.6 mil amorphous polypropylene/0.3 mil poly(ethyl vinyl acetate) where the amorphous polypropylene layer provides strength for the grippable tabs 17 and barrier and the poly(ethyl vinyl acetate) layer enables the hermetic seal to the substrate sheet. In this case, the flexible barrier sheet 21 is designed to maintain the freshness of the coffee cartridges 14 for a relatively short period of time after the cover 28 is removed from the substrate sheet. Also in this case, the covers 28 should have high barrier to oxygen, moisture and aroma required to maintain the freshness of the coffee cartridges for a long period of time during storage and transportation.

Figure 3B:
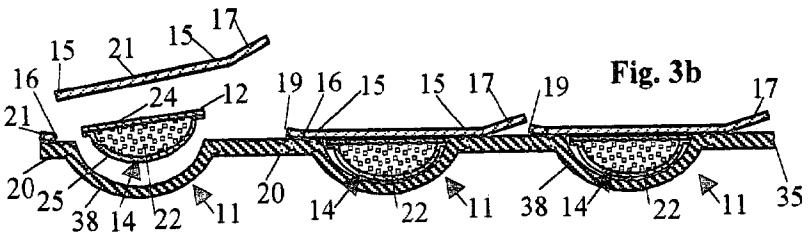
FIG. 3*b* is a sectional view along line b—b of FIG. 3 and also shows the dispensing of a coffee pack or pod from the sheet of sealed coffee grounds.
Figure 3:
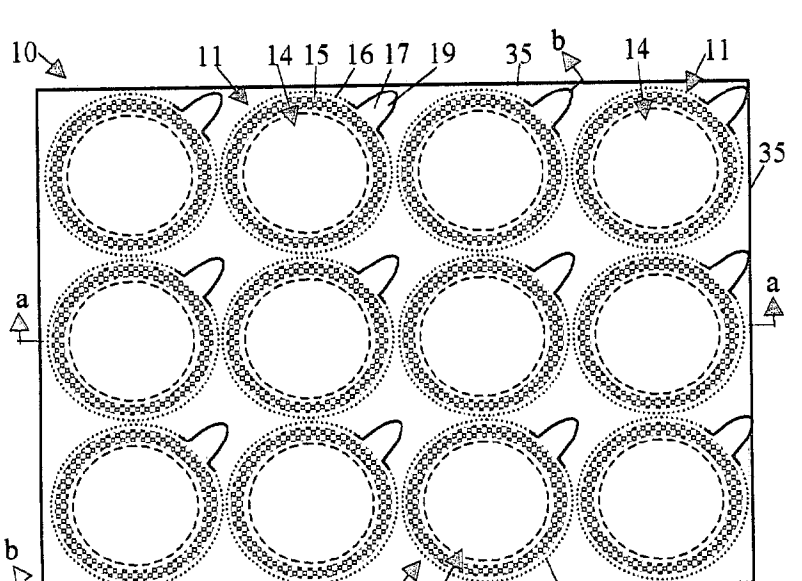
FIG. 3 is a top view of a sheet of sealed coffee grounds according to a third preferred embodiment of the invention.
Figure 3A:
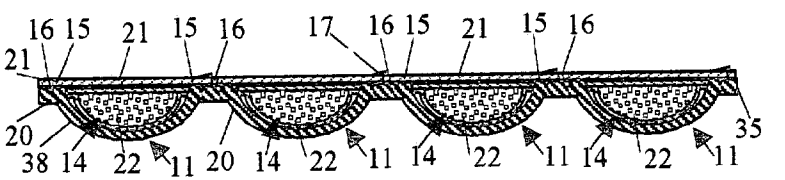
FIG. 3*a* is a sectional view along line a—a of FIG. 3.

FIGS. 3, 3*a* and 3*b* show a modified version of the sheet 10 of FIG. 1 according to another preferred embodiment of the invention. In this modified sheet 10, a plurality of cavities 38, each having an open top end, a side wall and a closed bottom, are formed on substrate sheet 20 and the flexible barrier sheet 21 is sealed via ring-shaped hermetic seals 15 to the edges of the open top ends of the cavities to form cartridge chambers 11. Due to the rigidity and strength of substrate sheet 10, cavities 28 or cartridge chambers 11 in this modified sheet 10 provide more protection against deformation and damage of the coffee cartridges than the cartridge chambers 11 in the sheet 10 of FIG. 1. Except for the sufficiently rigid cavities 38 formed on the substrate sheet, this modified sheet 10 is essentially the same as the sheet 10 of FIG. 1.

Figure 4B:
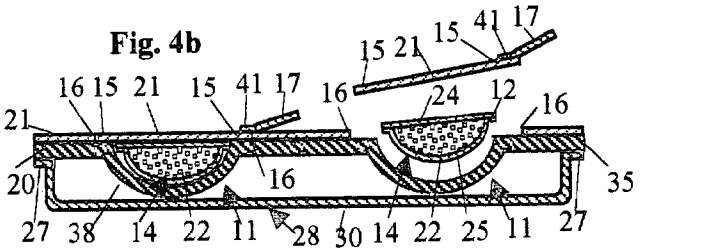
FIG. 4*b* is a sectional view along line b—b of FIG. 4 and also shows the dispensing of a coffee pack or pod from the sheet of sealed coffee grounds.
Figure 4:
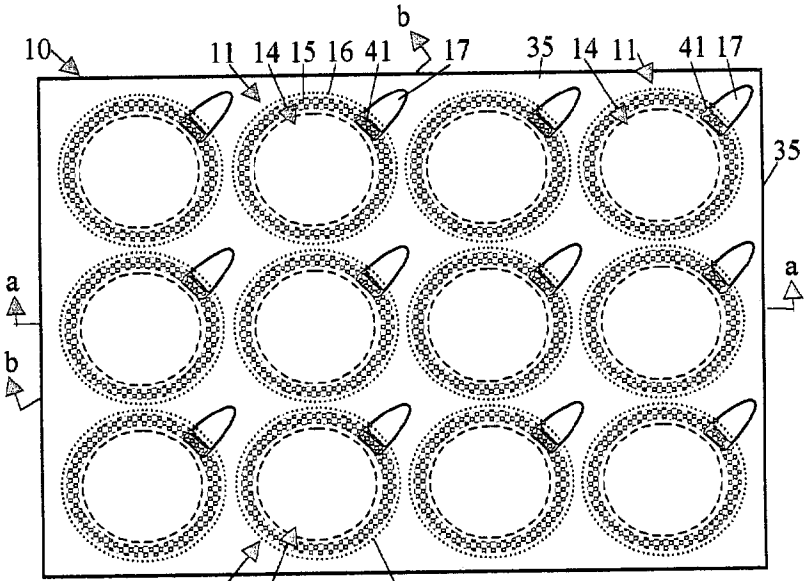
FIG. 4 is a top view of a sheet of sealed coffee grounds according to a forth preferred embodiment of the invention.
Figure 4A:
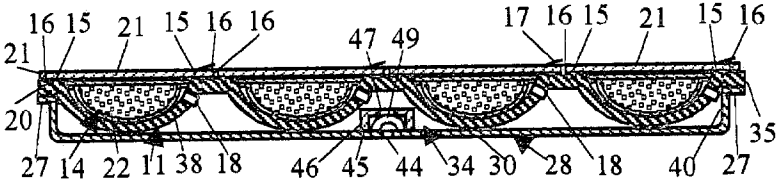
FIG. 4*a* is a sectional view along line a—a of FIG. 4.

The sheet of sealed coffee grounds 10 of FIGS. 4, 4*a* and 4*b* is the same as the sheet 10 of FIGS. 3, 3*a* and 3*b* except that it further comprises a cover 28, an anti-bulging device 34 and a gas conduction channel 18 on each cavity 38 to conduct the out-gassed carbon dioxide to device 34, that the grippable tabs 27 are attached to the flexible barrier sheet 21 rather than formed from the flexible barrier sheet, and that each cut line 18 consists of a circular perforated line 16. The cover 28 here is essentially the same as the cover 28 of FIG. 2 except that it is not intended to be removed by the consumers and therefore it does not have a handle 32. The anti-bulging device 34 comprises a first opening 44 on the flat bottom 30 of the cover 28, a cylindrical chamber 44 having a side wall 45 sealed to the bottom 30 and a second opening 47 to the top wall of the cylindrical chamber, and an elastomer ball 49 received in the cylindrical chamber to close the second opening. When the pressure above the second opening 49 develops due to the out-gassing of the coffee grounds, the pressure compresses or pushes down the ball 49 to open the second opening, thereby causing the carbon dioxide and pressure to be released. The gas conduction channels 18 conduct the out-gassed carbon dioxide from each cartridge chambers 11 to the anti-bulging device 34 to prevent over-pressurization and damage of the cartridge chambers 11.

The base 41 for each of the plurality of grippable tabs is attached by heat staking to the flexible barrier sheet 21. To reduce the force needed to open a cartridge chamber 11, the base 41 of the grippable tab 17 is connected to the part of the flexible barrier sheet that is sufficiently close to the ring-shaped hermetic seal 15. Preferably, at least part of the heat-staking area is at or beyond the outside edge of the hermetic seal 15. One advantage of attaching external grippable tabs to the flexible barrier sheet 21 rather than cutting the flexible barrier sheet to form the grippable tabs is the preservation of the integrity and gas barrier of the flexible barrier sheet. The external grippable tabs make it possible to use low barrier, thus lower cost, rigid materials such as polystyrene for the substrate sheet 20 since the substrate sheet is enclosed or sandwiched between the high barrier cover 28 and flexible barrier sheet 21. It is appreciated that a very tiny amount of oxygen and moisture may permeate through perforated cut lines 16 on the flexible barrier sheet 21 into the space between the substrate sheet 20 and the cover 28, which may later reach coffee grounds 22 in the cartridge chambers 11 through the side wall of the cavities 18. To minimize such permeation, a thin metal such as aluminum layer can be vacuum-deposited on the surface, preferably on the lower or bottom surface, of the substrate sheet. It was discovered that the vacuum-deposited metal layer was damaged or broken in the regions of the substrate sheet where the cavities 18 are formed. Fortunately, the vacuum-deposited metal layer in the regions of the substrate sheet directly below the perforated cut lines 16 remain intact after the formation of the cavities 18 on the substrate sheet to prevent the permeation through the perforated cut lines 16. It is was further discovered that with such vacuum-deposited metal layer on the substrate sheet, the grippable tabs 17 can be formed on the flexible barrier sheet 21 as described in the sheet 10 of FIG. 1 and no significant oxygen or moisture can reach the space between the substrate sheet 20 and the cover 28.

Figure 5B:
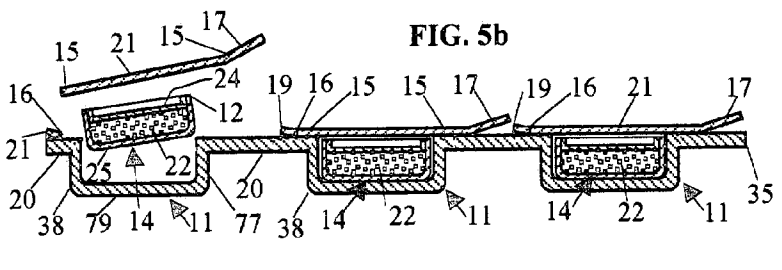
FIG. 5*b* is a sectional view along line b—b of FIG. 5 and also shows the, dispensing of a coffee pack or pod from the sheet of sealed coffee grounds.
Figure 5:
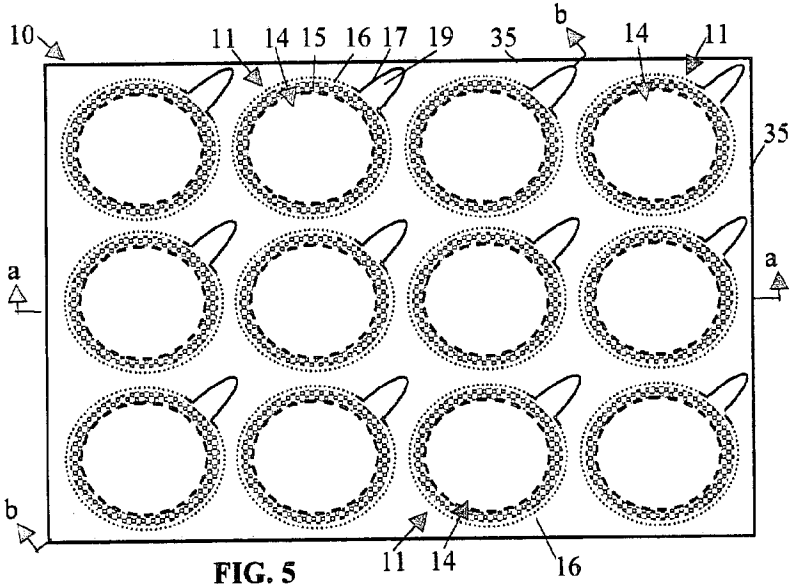
FIG. 5 is a top view of a sheet of sealed coffee grounds according to a fifth preferred embodiment of the invention.
Figure 5A:
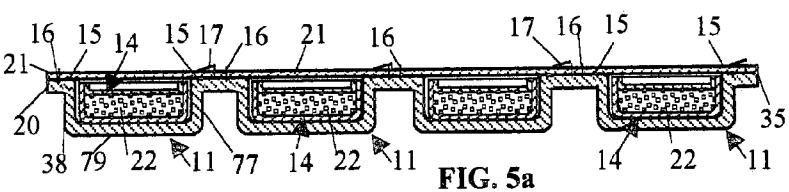
FIG. 5*a* is a sectional view along line a—a of FIG. 5.

The sheet of sealed coffee grounds 10 of FIGS. 5, 5*a* and *b* is the same as the sheet 10 of FIGS. 3, 3*a* and 3*b* except that here the cavities 38 formed on the substrate sheet 20 adopt a cylindrical shape and that the coffee cartridges 14 comprise vertical seams formed between the top and bottom paper filters 24 and 25. The cylindrically shaped cavities 38 provide the ideal protection and support for the new coffee cartridges 14, which was disclosed in the applicant U.S. patent application Ser. No. 10/190,399. Unlike the existing coffee packaging methods, the sheets 10 of FIGS. 4–5 and 8 causes close fit between coffee cartridges 14 and cavities 38, thus preventing movement of coffee grounds and changes in packing density of the coffee grounds in the cartridges during transportation and handling. In addition, the side wall of the cavities 38 is sufficiently rigid to protect the cartridges from being deformed during shipment and handling. It is appreciated that the sheet 10 may further comprise a cover 28 and/or an anti-bulging device 34 similar to those described in FIGS. 2 and 3. It is also appreciated that in this and other embodiments of the invention, the coffee grounds 22 can be replaced by other beverage materials such as tea, mocha mix, latte mix, Tang, instant coffee, creamer, cappuccino mix, roasted coffee grounds arranged in a mixed or layered form with soluble beverage material(s), and cocoa mix.

Figure 6D:
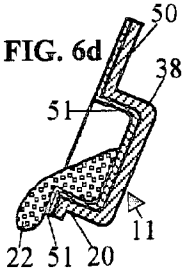
FIG. 6*d* shows the dispensing of the coffee grounds from the scoop of FIG. 6*c* into a filter basket (not shown)
Figure 6C:
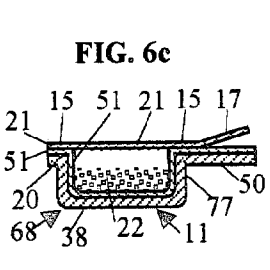
FIG. 6*c* is a sectional view of a sealed scoop of coffee grounds removed from the sheet of sealed coffee grounds
Figure 6B:
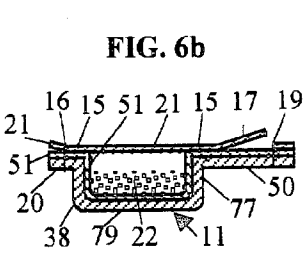
FIG. 6*b* is a sectional view along line b—b of FIG. 6.
Figure 6:
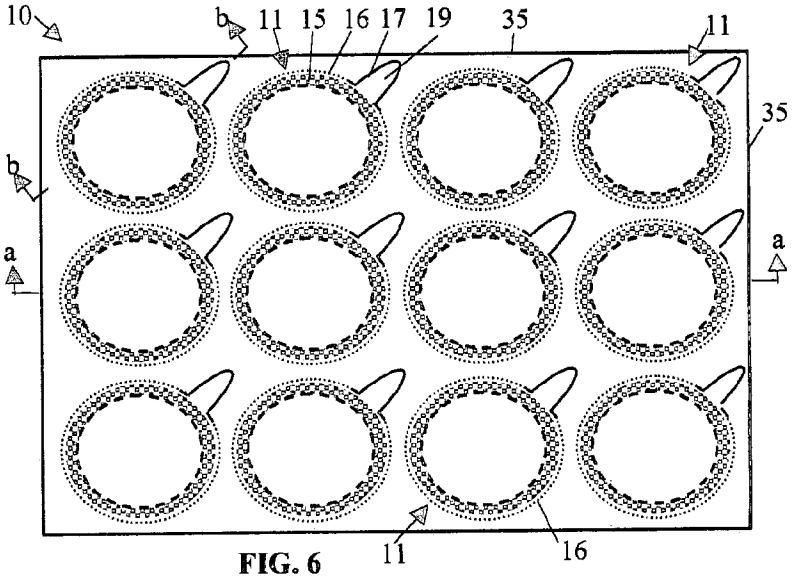
FIG. 6 is a top view of a sheet of sealed coffee grounds according to a sixth preferred embodiment of the invention.
Figure 6A:
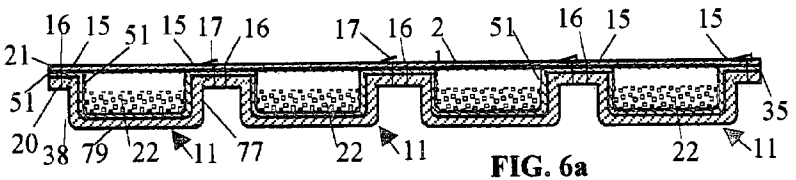
FIG. 6*a* is a sectional view along line a—a of FIG. 6.

The sheet 10 of FIGS. 6, 6*a* and *b* is the same as that of FIGS. 5, 5*a* and 5*b* except that in FIGS. 6, 6*a* and 6*b* the sheet 10 comprises a plurality of portions of loose coffee grounds 22 in the chambers 11, that the plurality of cut lines 18 are through both the flexible barrier sheet 21 and substrate sheet 20, and that the sheet 10 further comprises a barrier lining film 51. The barrier lining film 51 is sufficiently flexible to be pushed into the plurality of cavities 18 on substrate sheet 20 to form a lining layer for the top surface of the substrate sheet. To add maximum oxygen and aroma barrier to cavities 18, the barrier lining film comprises a metal foil or vacuum-deposited metal layer and sealant layers such as polyethylene and/or polyacrylic layers to allow the lining film to be heat-staked to substrate sheet 20 and the flexible barrier sheet 21.

With the cut lines 18 through the flexible barrier sheet 21, barrier lining film 51 and substrate sheet 20 (FIGS. 6*a* and *b*), a scoop 68 (FIG. 6*c*) can be obtained by removing a sealed chamber 11 along a cut line 18 from the sheet 10. The scoop comprises a chamber 11 or cavity 18 sealed by a part of flexible barrier sheet 21, a portion of loose coffee grounds 22 in the chamber 11, and a handle 50 (FIG. 6*c*). The handle 50 is formed by the clean-cut section 17 of cut line 18 and comprises the part of the rigid substrate sheet 20 below the grippable tab 19. During making coffee, one pulls the grippable tab 17 on scoop 68 to open cavity 18 and then holds handle 50 to dispense or pour the portion of coffee grounds 22 (FIG. 6*d*) into a basket filter or disposable paper filter for a coffee machine (not shown). Clearly, the sheet 10 of FIG. 6 has the advantages of providing a pre-measured portion of coffee grounds and opening the seal for each portion of coffee grounds just seconds before brewing, thus ensuring consistent brew strength and freshness. In comparison, a vacuum-packed can of coffee grounds requires manual measuring of coffee grounds for each brewing and provides stale coffee grounds after several uses because of the oxygen and moisture entering the can after each use.

In sheets 10 of FIGS. 1 to 6, it is appreciated that the peripheral edge for flexible barrier sheet 21 may be attached to the side wall 35 or the peripheral edge of substrate sheet 20 to prevent the remaining part of the flexible barrier sheet from separation from the substrate sheet after the dispensing of all the coffee cartridges 14 in the sheet 10. It is also appreciated that the part of the flexible barrier sheet 21 which is on the outside of the cut lines 18 can be removed from the substrate sheet 20 during the manufacturing process to further ensure that the opening of one cartridge chamber 11 will not compromise the hermetic seals 15 for the adjacent cartridge chambers. It is also appreciated that the perforated sections 16 of the cut lines 18 can be made as clean-cut sections. It is also appreciated that a cartridge chamber can be made sufficiently deep or large to contain two or more coffee cartridges. It is also appreciated that one cut line 18 and one grippable tab 19 may be formed around two or more cartridge chambers 11 and that one hermetic seal 15 and one grippable tab 19 may be formed around two or more cavities 38 on the substrate sheet 20. Since the two or more cartridge chambers 11 or cavities 38 in both the cases share one grippable tab 19, such two or more cartridge chambers or cavities will be regarded as one cartridge chamber in this and the Claims Sections. It is further appreciated that the flexible barrier sheet 21 may comprise a plurality of baby barrier sheets, and each baby barrier sheet comprises a grippable tab is attached to the substrate sheet via hermetic seal 15 to form a cartridge chamber 11.

According to a further preferred embodiment of the invention, FIG. 7*a* shows a plurality of rectangle-shaped sheets of sealed coffee grounds 10 attached to one another at their left sides by weak, breakable adhesive strips 59 and FIG. 7 shows a top view of the sheet 10. The sheet 10 of FIGS. 7 and 7*a* comprises a plurality of beverage cartridges 14, an upper flexible barrier sheet 21*a* having a top surface and a bottom surface, a lower flexible barrier sheet 21*b* sealed to the bottom surface of the upper flexible barrier sheet 21*a* to form a peripheral seal 60 and a plurality of horizontal and vertical seal strips 69 and 62 between the sheets. The peripheral seal 60, horizontal and vertical seal strips 69 and 62 define a plurality of hermetic cartridge chambers 61 for containing the plurality of beverage cartridges 14. A plurality of perforated lines 63 and 67 are formed on the plurality of horizontal and vertical seal strips, respectively, to allow a user to remove one or more cartridge chambers 61 from a sheet 10 along a perforated line without breaking the hermetic seal for the cartridge chambers 61. A plurality of nips or cuts 71 are formed on each horizontal seal strip 69 to allow a user to tear the sheets 21*a* and 21*b* at a nip to open a cartridge chamber 61 and remove the coffee cartridge 14 therein. FIG. 7*a* shows a sealed chamber 61 removed from sheet 10 and FIG. 7*c* shows the chamber 61 after it was tore open at the nip 71.

To prevent the undesired opening of cartridge chambers 61 during the removal of one or more cartridge chambers 61 from a sheet 10 along a perforated line, the sheet 10 further comprises a plurality of seal protectors 70 on the horizontal seal strips 69. The seal protector comprises an elongated slot 66 and one nip 71 on each side of the elongated slot. The elongated slot 66 should be sufficiently long to allow the nips 71 to be positioned sufficiently away from the ends of the elongated slot. The elongated slot 66 can be replaced by a clean-cut line of the same length.

FIGS. 8, 8*a* and 8*b* show a sheet 10 of sealed coffee grounds according to a further preferred embodiment of the invention. The sheet 10 comprises a plurality of coffee cartridges 14, a substrate sheet 20 having a plurality of cylindrical cavities 38 formed thereon for receiving the plurality of coffee cartridges, and an easy-to-break barrier film 52 hermetically sealed to the top surface of the substrate sheet 20 to close the plurality of cavities 38 to form a plurality of closed chambers 11. Each cylindrical cavity 38 has a bottom wall 79 and a cylindrical side wall 77. The film 52 is sufficiently weak to allow it to break when a user pushes the bottom wall 79 towards the film 52, therefore allowing a user to dispense or remove a coffee cartridge from the sheet 10 by simply pushing a bottom wall 79 of a cavity 38 (FIG. 8*b*). One problem with such easy-to-break barrier film 52 is the undesired the breaking the film 52 during storage, handling and transportation. To prevent such undesired the breakage, the bottom wall 79 of the cavity 38 is preferably to be flat and the side wall 79 is preferably to be rigid. A flat bottom wall 79 was found to be able to dissipate the force exerted to the bottom wall by adjacent sheets 10 during transportation and storage. A sufficiently rigid side wall 79 prevents the collapse of cavity 38 when a stack of sheets 10 are compressed against each other during transportation and storage.

The sheet 10 further comprises a gas-impervious cover 28 having a substantially flat bottom wall 30 parallel to easy-to-break barrier film 52 for facilitating the stacking of sheets 10, a side wall 40 and a peripheral fringe 27 sealed to the peripheral edge of the substrate sheet 20. A plurality of visual indicators 57 are formed on the bottom wall 30 of the cover 28 to indicate the positions of the bottom walls 79 for cavities 38, thus provide a guide to a user about where to push to dispense a coffee cartridge in the sheet. A punch protector 54 is attached around its edge 55 to the peripheral edge of the substrate sheet 20 for preventing the breakage of the easy-to-break barrier film 52 during storage and transportation. The punch protector has a handle 31 for facilitating its removal from the sheet 10 prior to use and a hole 32 for allowing the sheet 10 to be hanged on a hanger.

Clearly, the modifications for the coffee package can be combined into or removed from any of the exemplar embodiments of the invention. The scope of the invention is obviously not restricted to the embodiments described by way of examples and depicted in the drawings, there being numerous changes, modifications, additions, and applications thereof imaginable within the purview of the claims.

What is claimed is:

1. A sheet of sealed flavor-containing beverage materials for the preparation of beverage with aqueous media comprising:

a plurality of beverage cartridges, each said beverage cartridge comprising a predetermined amount of flavor-containing materials and a filtration chamber for containing said predetermined amount of flavor-containing materials and for allowing said flavor-containing materials to interact with aqueous media therein to produce a beverage, said filtration chamber being adapted to allow the beverage to flow out but to retain solids therein;

a substrate sheet having a first surface, a second surface and a side wall;

a flexible barrier sheet adapted to seal to said first surface of said substrate sheet to form a plurality of cartridge chambers for containing said plurality of beverage cartridges, each of said plurality of cartridge chambers comprising a hermetic seal between said flexible barrier sheet and said substrate sheet to prevent the loss of aroma or flavor of said flavor-containing materials therein; and a plurality of grippable tabs on said flexible barrier sheet for dispensing said beverage cartridges, said plurality of grippable tabs being adapted to allow a user to dispense a beverage cartridge in said sheet of sealed flavor-containing materials by simply pulling a grippable tab to open a cartridge chamber and release the beverage cartridge therein, wherein said flexible barrier sheet and substrate sheet are configured to sufficiently isolate said plurality of cartridge chambers from each other so that opening of one cartridge chamber by pulling a grippable tab for said cartridge chamber will not break the hermetic seal for an adjacent cartridge chamber.

2. A sheet of sealed flavor-containing materials as defined in claim 1 wherein said hermetic seals for said cartridge chambers adopt a substantially ring-like shape and said grippable tabs are arranged approximately 15 to 75 degrees relative to a center line connecting the centers of the hermetic seals in a row of cartridge chambers in said sheet of sealed flavor-containing materials.

3. A sheet of sealed flavor-containing materials as defined in claim 1 further comprising a plurality of peripheral cut lines for said plurality of cartridge chambers, each of said plurality of cut lines comprising a first section for sufficiently isolating a cartridge chamber from its adjacent cartridge chamber(s) and a second section for forming a grappable tab for said cartridge chamber.

4. A sheet of sealed flavor-containing materials as defined in claim 3 wherein said first section is perforated and said second section is clean-cut.

5. A sheet of sealed flavor-containing materials as defined in claim 3 wherein said second section of said peripheral cut line and at least the part of said first section adjacent to said second section are located outside said hermetic seal for facilitating the opening of said cartridge chamber by pulling said grippable tab.

6. A sheet of sealed flavor-containing materials as defined in claim 1 wherein said grippable tabs are integral with said flexible barrier sheet and formed by cutting said flexible barrier sheet according to a predetermined pattern.

7. A sheet of sealed flavor-containing materials as defined in claim 1 wherein said grippable tabs are at least partially lifted up from said substrate sheet during the manufacturing of said sheet of sealed flavor-containing materials.

8. A sheet of sealed flavor-containing materials as defined in claim 1 wherein said plurality of grippable tabs are connected to said flexible barrier sheet at positions sufficiently close to said hermetic seals to facilitate the dispensing of said beverage cartridges.

9. A sheet of sealed flavor-containing materials as defined in claim 1 wherein at least one of said flexible barrier sheet and substrate sheet is perm-selective for the carbon dioxide out-gassed by said flavor-containing materials.

10. A sheet of sealed flavor-containing materials as defined in claim 1 wherein said substrate sheet is adapted to have sufficient rigidity to prevent or reduce deformation during pulling said grippable tabs, thereby facilitating the dispensing of said beverage cartridges from said sheet of sealed flavor-containing materials.

11. A sheet of sealed flavor-containing materials as defined in claim 10 wherein said substrate sheet comprises a mechanical support structure including at least one of paper board, wood, paper, foamed plastics, plastic and metal sheets of sufficient thickness for providing said rigidity and a barrier layer including one of metallic foil, vacuum-deposited metal layer and polymeric barrier layer for providing sufficient gas barrier to said substrate sheet.

12. A sheet of sealed flavor-containing materials as defined in claim 10 further comprising a cover for covering and protecting said plurality of cartridge chambers, said cover having a substantially flat wall located substantially parallel to said substrate sheet for facilitating the stacking of a plurality of said sheets of sealed flavor-containing materials over each other.

13. A sheet of sealed flavor-containing materials as defined in claim 12 further comprising an anti-bulging device for preventing said cover from bulging out as a result of out-gassing by said flavor-containing materials, said anti-bulging device including one of an absorber for absorbing the out-gas and an one-way valve adapted for releasing the out-gas.

14. A sheet of sealed flavor-containing materials as defined in claim 13 further comprising means to conduct the out-gas from said plurality of cartridge chambers to said anti-bulging device, thereby preventing said plurality of cartridge chambers from over-pressurization and breakage.

15. A sheet of sealed flavor-containing materials as defined in claim 10 further comprising a plurality of cavities formed on said substrate sheet for receiving said plurality of beverage cartridges, said plurality of cavities being closed by said flexible barrier sheet and said hermetic seals to form said plurality of cartridge chambers.

16. A sheet of sealed flavor-containing materials as defined in claim 15 further comprising a gas-impervious cover sealed to said second surface of said substrate sheet for covering said plurality of cavities, thereby preventing the loss of flavor or aroma of said flavor-containing materials due to the reduced oxygen and aroma barrier of said substrate sheet caused by the formation of said cavities.

17. A sheet of sealed flavor-containing materials as defined in claim 16 wherein said plurality of grippable tabs are attached externally to said flexible barrier sheet, thereby substantially preserving the integrity and aroma and oxygen barrier of said flexible barrier sheet.

18. A sheet of sealed flavor-containing materials as defined in claim 16 further comprising a plurality of cut lines on said flexible barrier sheet to isolate said plurality of cartridge chambers from each other.

19. A sheet of sealed flavor-containing materials as defined in claim 16 further comprising an anti-bulging device for preventing said gas-impervious cover from bulging out as a result of the out-gassing by said flavor-containing materials, said device comprising one of an absorber for absorbing the out-gas and an one-way valve adapted for releasing the out-gas.

20. A sheet of sealed flavor-containing materials as defined in claim 15 further comprising a barrier lining film having at least one of metal foil and vacuum deposited metal layer, said lining barrier film being adapted to be pushed into said plurality of cavities and to be heat-attachable to said first surface of said substrate sheet and to said flexible barrier sheet.

21. A sheet of sealed flavor-containing materials as defined in claim 1 wherein said flexible barrier sheet comprises a plurality of baby barrier sheets attached to said substrate sheet via said hermetic seals to form said plurality of cartridge chambers, each said baby barrier sheet having a grippable tab.

22. A sheet of sealed flavor-containing materials as defined in claim 1 further comprising a second flexible barrier sheet adapted to form a plurality of hermetic seals to said second surface of said substrate sheet to form a second plurality of cartridge chambers for containing a second plurality of beverage cartridges, and a second plurality of grippable tabs on said second flexible barrier sheet for dispensing said second plurality of beverage cartridges.

23. A sheet of sealed flavor-containing beverage materials for the preparation of beverage with aqueous media comprising:

a plurality of portions of beverage materials, each portion of beverage materials comprising a predetermined amount of flavor-containing materials for making a cup or pot of beverage by interacting with aqueous media;

a substrate sheet having a first surface, a second surface, and a plurality of cavities formed on said substrate sheet for receiving said plurality of portions of beverage materials;

a flexible barrier sheet adapted to seal to said first surface of said substrate sheet to form a plurality of hermetic seals between said flexible barrier sheet and substrate sheet to close said plurality of cavities, thereby preventing loss of aroma or flavor of said plurality of portions of beverage materials enclosed between said flexible barrier sheet and said plurality of cavities; and a plurality of grippable tabs on said flexible barrier sheet for dispensing said plurality of portions of beverage materials, said plurality of grippable tabs being adapted to allow a user to dispense a portion of the beverage materials by simply pulling a grippable tab to open a cavity and release the portion of beverage materials therein.

24. A sheet of sealed flavor-containing materials as defined in claim 23 further comprising a cut line around each of said plurality of closed cavities for allowing the removal of a closed cavity along said cut line from said sheet of sealed flavor-containing materials.

25. A sheet of sealed flavor-containing materials as defined in claim 24 wherein said cut line comprises a perforated section for connecting said closed cavity to said substrate sheet and a clean-cut section for forming said grappable tab for said closed cavity.

26. A sheet of sealed flavor-containing materials as defined in claim 24 wherein said substrate sheet is adapted to have sufficient rigidity to act as a frame to facilitate the removal of said closed cavity.

27. A sheet of sealed flavor-containing materials as defined in claim 26 wherein said cut line is shaped to allow a handle to be formed as an integral part of said closed cavity during the removal of said closed cavity from said sheet of sealed flavor-containing materials.

28. A sheet of sealed flavor-containing materials as defined in claim 27 wherein said plurality of portions of beverage materials are loosely contained in said plurality of cavities, whereby during making beverage a user pulls a grippable tab on a closed cavity removed from said sheet of sealed flavor-containing materials to open said closed cavity and holds said handle to pour the portion of beverage materials therein into a filter for beverage apparatus.

29. A sheet of sealed flavor-containing materials as defined in claim 23 further comprising a plurality of filtration chamber for containing said plurality of portions of beverage materials, each of said plurality of filtration chamber comprising a top filter, a bottom filter and a seam formed between said filters to enclose one of said plurality of portions of beverage materials.

30. A sheet of sealed flavor-containing materials as defined in claim 23 further comprising a barrier lining film having at least one of metal foil and vacuum deposited metal layer, said lining barrier film being adapted to be pushed into said plurality of cavities and to be heat-attachable to said first surface of said substrate sheet and to said flexible barrier sheet.

31. A sheet of sealed flavor-containing materials as defined in claim 23 wherein said flexible sheet comprises a plurality of baby barrier sheets attached to said substrate sheet via said hermetic seals to form said plurality of cartridge chambers, each said baby barrier sheet having a grippable tab.

32. A sheet of sealed flavor-containing materials as defined in claim 23 wherein said hermetic seals adopt a substantially ring-like shape and said grippable tabs are arranged approximately 15 to 75 degrees relative to a center line connecting the center points of the hermetic seals in a row of said cavities.

33. A sheet of sealed flavor-containing materials as defined in claim 23 further comprising a gas-impervious cover sealed to said second surface of said substrate sheet for covering said plurality of cavities, thereby preventing the loss of flavor or aroma of said beverage materials in said cavities due to the reduced barrier of said substrate sheet to oxygen and aroma caused by the formation of said cavities.

* * * * *